US005727508A

United States Patent [19]

Goppelt

[11] Patent Number: 5,727,508

[45] Date of Patent: Mar. 17, 1998

[54] PRESSURE MEDIUM SEALING IN A CAMSHAFT ADJUSTING DEVICE

[75] Inventor: Dieter Goppelt, Aurachtal, Germany

[73] Assignee: Ina Walzlager Schaeffler KG, Germany

[21] Appl. No.: 760,842

[22] Filed: Dec. 5, 1996

[30] Foreign Application Priority Data

Dec. 15, 1995 [DE] Germany ..... 195 46 934.8

[51] Int. Cl.[6] ..... F01L 1/344

[52] U.S. Cl. ..... 123/90.17; 123/90.31; 123/90.37; 74/568 R; 464/2

[58] Field of Search ..... 123/90.15, 90.17, 123/90.31, 90.33, 90.34, 90.37, 90.38; 74/568 R, 567; 464/1, 2, 160, 161

[56] References Cited

U.S. PATENT DOCUMENTS

| | | | |
|---|---|---|---|
| 5,090,365 | 2/1992 | Hotta et al. | 123/90.17 |
| 5,201,289 | 4/1993 | Imai | 123/90.17 |
| 5,309,873 | 5/1994 | Suga et al. | 123/90.17 |
| 5,377,639 | 1/1995 | Nakadouzono et al. | 123/90.17 |
| 5,588,404 | 12/1996 | Lichti et al. | 123/90.17 |

FOREIGN PATENT DOCUMENTS 4227619 2/1993 Germany .

*Primary Examiner*—Weilun Lo

*Attorney, Agent, or Firm*—Bierman, Muserlian and Lucas

[57] ABSTRACT

A device for the continuous variation of a relative angular position between a crankshaft and a camshaft of an internal combustion engine comprising a drive element (2) driven by the crankshaft of the internal combustion engine through a traction means, a sliding sleeve (7) which is positively locked by a first gearing (8, 9) to the drive element (2) and by a second gearing (10, 11) to a driven element (13), and an adjusting piston (6) which is fixed on the sliding sleeve (7) and guided in a housing (3) to axially delimit two pressure chambers (14, 15) which are sealed from each other by a sealing arrangement whereby a radially inward oriented sealing of the sliding sleeve (7), is achieved by providing a sealing disc (17) of continuous configuration which bears against an inner wall (19) of the sliding sleeve (7).

14 Claims, 6 Drawing Sheets

PRESSURE MEDIUM SEALING IN A CAMSHAFT ADJUSTING DEVICE

FIELD OF THE INVENTION

The invention concerns a device for the continuous variation of a relative angular position between a crankshaft and a camshaft arranged in a cylinder head, said device comprising:

a drive pinion driven by the crankshaft through a traction means, particularly a belt, a hollow cylindrical sliding sleeve positively locked by a first gearing to the drive pinion and by a second gearing directly or indirectly to the camshaft, a hydraulic adjusting piston fixed on the sliding sleeve and guided in a housing to define two pressure chambers which can be connected alternately to a pressure medium supply and a pressure medium discharge, and a sealing arrangement to seal the pressure chambers from each other whereby the adjusting piston is sealed relative to the housing and the sliding sleeve is sealed directly or indirectly relative to a drive element.

BACKGROUND OF THE INVENTION

In a device of the aforesaid type disclosed in DE 4,321,003, a sealing of the pressure chambers is achieved by a sealing ring arranged around the adjusting piston to bear against the inner wall of the housing and a piston ring inserted between the sliding sleeve and components situated inwardly thereof. More particularly, the piston ring is arranged between opposing end faces of the drive element and the driven element and bears by its outer periphery sealingly against an inner wall of the sliding sleeve between helical gear sections thereof. To simplify the mounting of the piston ring, at least one tooth is omitted in the inner gearing of the sliding sleeve so that the piston ring can be inserted more easily between the gear sections of the sliding sleeve. Radial impacts caused by gearing and by manufacturing diameter tolerances have a negative effect on the sealing, Due to its inherent properties, the split piston ring used for sealing cannot adequately counteract the influences which detract from an effective sealing so that a detrimental pressure medium loss can occur. Therefore, to reduce the loss of pressure medium, the adjusting device has to be tested for proper functioning or an exact verification of the dimensions of all components associated to the sealing arrangement is required, particularly of the internal bore of the sliding sleeve and the diameter of the piston ring.

OBJECTS OF THE INVENTION

It is an object of the invention to create an improved sealing arrangement for the pressure chambers which can be mounted in a simple manner.

It is another object of the invention is to simplify the manufacturing of the components between which the sealing arrangement is disposed.

These and other objects and advantages of the invention will become obvious from the following detailed description.

SUMMARY OF THE INVENTION

The invention achieves the above objects in four different ways. A common feature of all the solutions offered by the invention is the continuous configuration of the sealing disc or the seal or the sealing ring, respectively, used to obtain a sealed contact of these sealing elements on the inner wall of the sliding sleeve. In this way, an effective radial sealing is obtained whose sealing function remains uninfluenced even in the presence of radial impacts caused by diameter tolerances of adjacent components. The embodiments of the invention effectively preclude pressure medium leakage and thus advantageously reduce the adjusting times of the device and the need for re-setting during continuous adjustment. Further, mounting is simplified in all the embodiments because the seals or sealing elements provided by the invention can be preassembled without respect to special installation requirements or interaction with adjacent components which results in a saving of time and costs.

The use of the sealing disc or the seal of the invention obviates the need of reworking the inner wall of the sliding sleeve in the sealing region with the aim of smoothening the surface roughness, so that a further cost advantage is obtained.

The sealing disc of the first embodiment of the invention which, at the same time, acts as a thrust bearing, can be a narrow i.e., a thin-walled disc which can be made of a variety of materials with small or close manufacturing tolerances to obtain high-quality sealing. The sealing disc of the invention is inserted axially between two components distinct from the sliding sleeve.

In a second embodiment of the invention, sealing is achieved by a seal comprising two discs likewise having a continuous configuration with interposition of an elastic intermediate element, all of these three parts together making up the seal. Due to the axially spaced arrangement of the sealing discs, this seal acts as a labyrinth seal and therefore possesses improved sealing properties. The seal which is inserted between end faces of the drive and the driven element i.e., between components distinct from the sliding sleeve, and which additionally acts as a thrust bearing, exhibits a desired high damping effect due to the elastic intermediate element and thus also has a positive influence on noise development in the device. In addition, this sealing disc arrangement assures a better and more effective protection against pressure medium leakage from the pressure chambers during a standstill of the internal combustion engine i.e., a pressure medium leakage through a sliding mounting location between the toothed bushing or the driven element and the drive flange which is connected rotationally fast to the guide sleeve.

In a third embodiment of the invention, a sealing ring positionally fixed on the drive element comprises at least one sealing lip which bears under pre-tension against the inner wall of the sliding sleeve. This sealing lip which is dragged along during adjusting movements i.e., during an axial displacement of the sliding sleeve, assures a high degree of sealing in both directions. The sealing action can be further improved by a suitable configuration of the sealing lip so that the pressure of the pressure medium intensifies the contact pressure of the sealing lip.

In a fourth embodiment of the invention, a sealed fitting piece positionally fixed on the housing and having a circular ring-shape is arranged between the housing and a toothed sleeve and axially delimits one of the pressure chambers. An annular gap between the peripheral surface of the toothed sleeve and the fitting piece is effectively sealed by an inserted sealing element. This sealing element is guided only axially in the fitting piece so that, on occurrence of radial impacts of the drive element, the sealing element can follow these movements without a deterioration of the quality of sealing. By reason of a closely toleranced matching between the inner diameter of the sealing element and the peripheral surface of the toothed sleeve, advantageously done by a polishing of these two surfaces, a high quality of sealing is obtained.

In preferred developments of the above embodiments of the invention, the sealing disc or the seal, as the case may be, has a radial dimension extending over the entire end faces of the drive and the driven element. This configuration results in a reduction of surface pressure and thus also in a desired reduction of wear in the sealing disc or seal which, at the same time, acts as a thrust bearing. A supplementary measure for the reduction of wear is the use of a hardened sealing disc or seal so that different strengths can be obtained in a controlled manner between the sliding partners, that is to say, between the drive and the driven element on the one hand and the sealing disc or seal, as the case may be, on the other. Design space requirements can be optimized by using a thin-walled sealing disc or seal having a wall thickness of at most 4 mm. The material for making the sealing disc or seal is preferably steel. Alternative materials are nonferrous heavy metals or plastics such as, for example, PA 46 GF, PPS-GF 40 or PPA-GF 30.

In another development of the invention, an elastic intermediate element is used whose outer diameter is smaller than that of the discs arranged on either side thereof whereby the labyrinth effect of the seal is intensified due to the radial annular gap thus formed. Besides this, the annular gap permits an unobstructed deformation of the elastic intermediate element on the occurrence of axial loads, i.e., the elastic intermediate element can yield in radial direction without coming into contact with the inner wall of the sliding sleeve which would detrimentally increase the adjusting force of the device due to the presence of a greater frictional force.

The invention further provides a seal in which the elastic intermediate element is only fixed to one of the discs, for instance, by gluing, and the second disc is a loose part. This configuration permits a desired independent adjustment and orientation of the disc with a view to improving sealing efficiency. As an alternative, the three elements making up the seal can be inserted as separate parts into the device. It is also possible to configure one of the discs as a fitting disc by which an exact guidance on the inner wall of the sliding sleeve can be obtained.

According to a further development, the sealing ring is a two-lip sealing ring whose parallel sealing lips spread away from each other so that, on pressurization, they are pressed against the inner wall of the sliding sleeve and intensify the sealing action. It is further possible to use a sealing ring which is enclosed in a sheet metal sleeve. This reinforcement enables the sealing ring to be mounted and positioned more simply. The metal sleeve favors the obtention of pre-determined installation positions of the sealing ring if, for example, the width of the metal sleeve is made larger than the width of the sealing ring so that the metal sleeve extends beyond the sealing ring on one side. In response to specific requirements, the width of the sheet metal sleeve may likewise be made to correspond to or be smaller than the width of the sealing ring. As an alternative, it is also possible to use a sheet metal ring having radial flanges which, to create an inseparable structural unit, are sprayed over with the elastic sealing material.

The sealing ring is preferably arranged in a stepped end section of the drive element. This facilitates the pre-assembly of the sealing ring and assures that the sealing ring bears sealingly against the inner wall of the sliding sleeve in all positions thereof. To facilitate the mounting and installation of the different sealing elements of the invention viz., sealing disc, seal and sealing ring, the sliding sleeve is provided at one end, in a transition region to its inner wall, with a circumferential bevel. This bevel is particularly advantageous in the case of devices in which the sealing element is a sealing ring because the bevel prevents a damaging of the sealing lips during an axial mounting of the sliding sleeve on an axially projecting cylindrical portion of the drive element.

BRIEF DESCRIPTION OF THE DRAWINGS

The six figures of the drawings show five different embodiments of the invention.

DETAILED DESCRIPTION OF THE DRAWINGS

Figure 1:
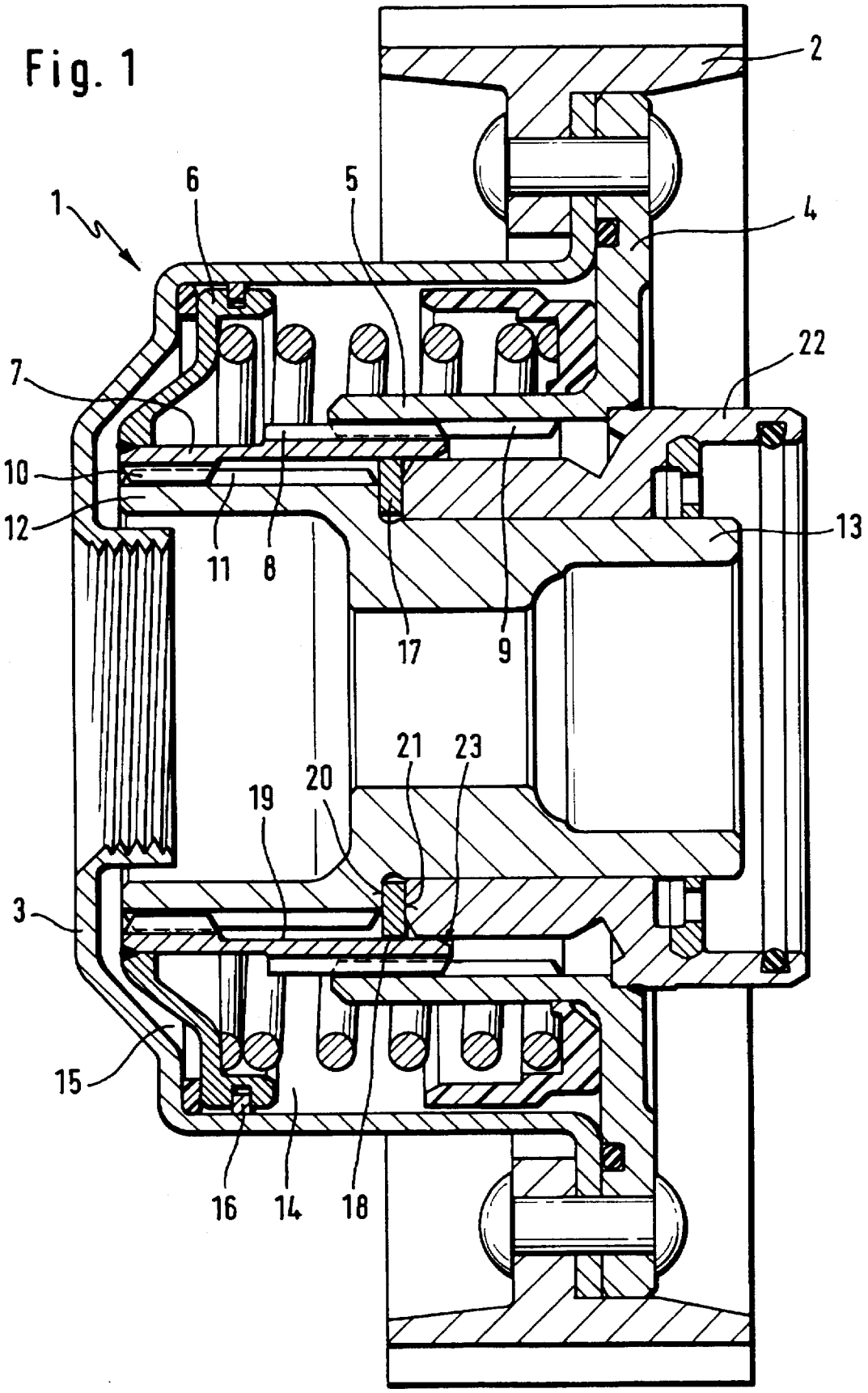
FIG. 1 is a longitudinal cross-section through a device of the invention using a sealing disc for a radial inward sealing between the pressure chambers.

FIG. 1 shows a device identified at 1 for varying opening and closing times of gas exchange valves of an internal combustion engine. The device is placed in axial direction in front of a camshaft, not shown, and comprises a drive element 2 in the form of a drive pinion which is driven through a traction means by a crankshaft, not shown, of the internal combustion engine. The drive element 2 is integrally connected to a housing 3 and a drive flange 4, the housing 3 being arranged radially spaced from and concentric with a bush 5 connected to and projecting axially from the drive flange 4. An adjusting piston 6 arranged slidably in the housing 3 is integrally connected to a hollow cylindrical sliding bush 7 comprising a first gearing 8, 9 by which it is positively locked with the bush 5 of the drive flange 4, and a second gearing 10, 11 by which it interlocks with a toothed bushing 12. This toothed bushing 12 is part of a driven element 13 which, in the installed state of the device 1, is arranged in axial extension of the camshaft on which it is fixed rotationally fast.

The gearings 8 to 11 are made as helical gears so that an axial displacement of the sliding sleeve 7 causes a relative rotation between the drive element 2 and the driven element 13. The circular ring-shaped adjusting piston 6 is arranged in the housing 3 so as to axially delimit two pressure chambers 14, 15 in the housing 3, which pressure chambers 14, 15 can be alternately loaded by a pressure medium to axially displace the adjusting piston 6 of the associated sliding sleeve 7. The pressure medium used to pressurize the pressure chambers 14, 15 is preferably lubricant fed to the device from the self-contained forced-feed lubrication of the internal combustion engine. To effectively seal the pressure chambers 14, 15 radially outwardly, a sealing ring 16 guided in the adjusting piston 6 and bearing against the housing 3 seals a leak gap formed between the adjusting piston 6 and the inner wall of the housing 3. A radially inward sealing of the pressure chambers 14, 15 is obtained by a sealing disc 17 whose peripheral surface 18 bears sealingly against an inner wall 19 of the sliding sleeve 7. The sealing disc 17 additionally assumes the function of a thrust bearing by virtue of being arranged between respective end faces 20 and 21 of the toothed bushing 12 and of a guide sleeve 22 arranged radially inwardly of the bush 5 while being integrally fixed to the drive flange 4. To facilitate the mounting of the sealing disc 17, the end of the sliding sleeve 7 nearer the guide sleeve 22 comprises a circumferential bevel 23 in a transition region to the inner wall 19.

Figure 2:
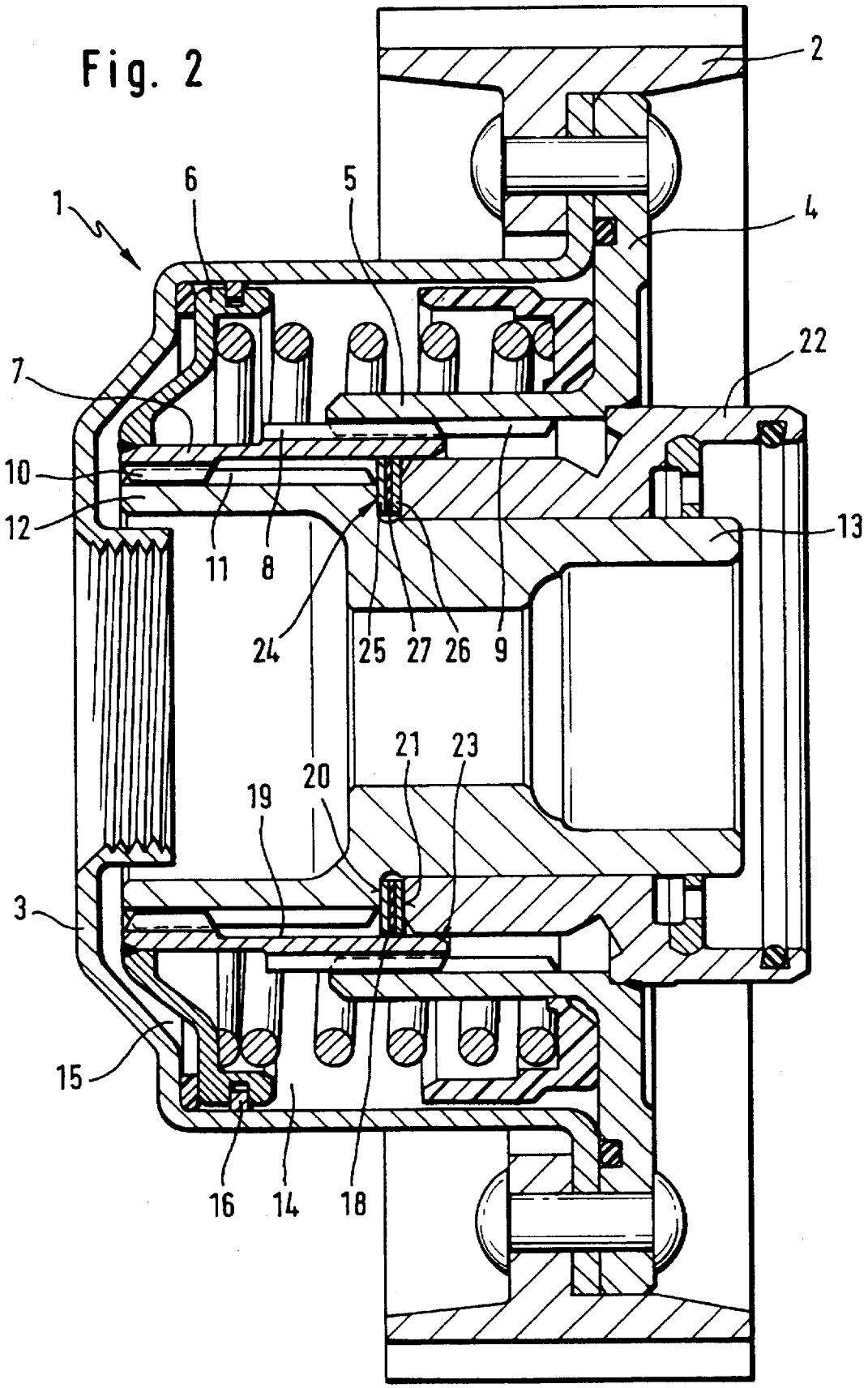
FIG. 2 shows the device of FIG. 1 but with two parallel sealing discs between which is arranged an elastic element.
Figure 3:
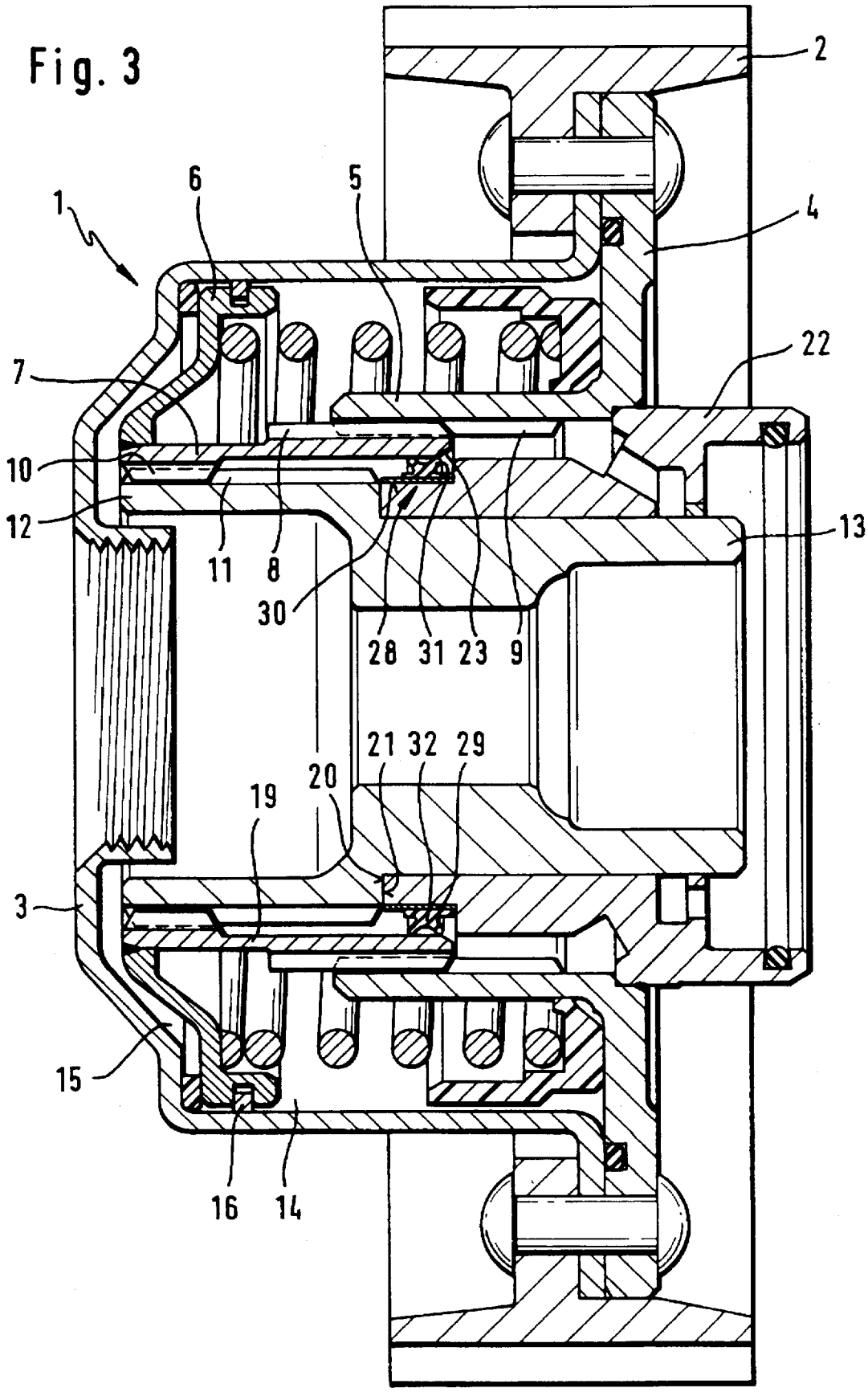
FIG. 3 shows the device of FIG. 1 in which sealing is achieved by a sealing ring whose sealing lips bear under pre-tension against the inner wall of the sliding sleeve.

In the embodiments of the device I of the invention shown in FIGS. 2 and 3, all parts corresponding to the first embodiment are designated by the same reference numbers so that, for their description, reference may be made to the elucidations given in connection with the first embodiment.

In the embodiment of FIG. 2, an effective, radially inward sealing between the pressure chambers 14, 15 is obtained by a seal 24 comprising two thin-walled discs 25, 26 which are axially spaced from one another and bear sealingly against the inner wall 19 of the sliding sleeve 7. An elastic element 27 is arranged between the discs 25 and 26 and has a damping effect, particularly a noise damping effect, when axial forces occur between the toothed bush 12 and the guide sleeve 22.

The device 1 of FIG. 3 shows a further alternative sealing arrangement comprising a sealing ring 28 stiffened by a surrounding sheet metal sleeve 29 which is preferably force-locked on a stepped end section 30 of the guide sleeve 22. The sealing ring 28 further comprises a sealing body 32 having two radially outward oriented sealing lips 31 which bear with pre-tension sealingly against the inner wall 19 of the sliding sleeve 7.

Figure 4:
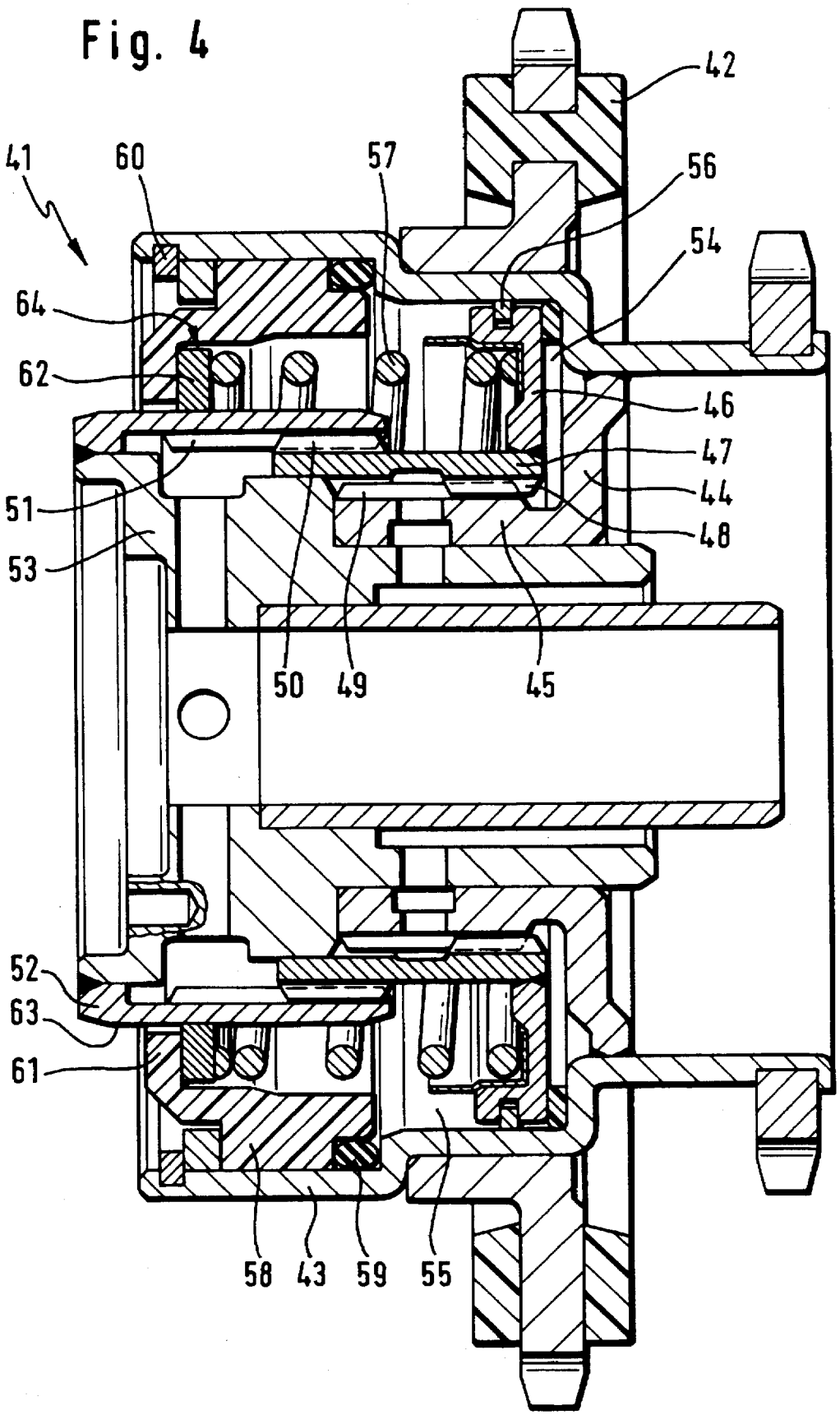
FIG. 4 shows the device of the invention in which an annular gap formed between a fitting piece disposed in the housing and a toothed sleeve is sealed by a sealing disc.

FIG. 4 shows a device 41 of the invention which, in contrast to the device 1, comprises a housing 43 which coaxially surrounds individual components of the adjusting device without, however, covering them at the ends. The device 41 is intended for an internal combustion engine whose traction drive, particularly a chain drive, for driving the camshaft is arranged in a liquid-tight housing. A further difference lies in the arrangement of the gears of the sliding sleeve 47. A transmission of the torque i.e., a flow of force takes place from the drive element 42 to the housing 43 and from there to the drive flange 44. An axially projecting cylindrical portion of the drive flange 44 forming the bush 45 is partially surrounded coaxially by the sliding sleeve 47 and positively locked therewith by the 48, 49. At its end away from the drive flange 44, the sliding sleeve 47 is connected by a gearing 50, 51 to a toothed sleeve 52 which partially encloses the sliding sleeve 47. The toothed sleeve 52 is undetachably connected to the driven element 53 which, in turn, in the installed state, is secured rotationally fast on the camshaft.

The adjusting piston 46 which is guided in the housing 43 while being arranged on the end of the sliding sleeve 47 nearer the drive flange 44, delimits the pressure chambers 54 and 55. A sealing between the pressure chambers is achieved by a sealing ring 56, and a displacement of the adjusting piston 46 into the position shown in FIG. 4 is effected by a compression spring 57. A fitting piece 58 is arranged in a radially outward stepped portion of the housing 43 and is sealed by a sealing ring 59 while being positionally fixed by a securing ring 60. The fitting piece 58 comprises a radially inward oriented shoulder 61 which with its end face oriented toward the pressure chamber 55 forms a stop for a sealing disc 62 which is guided on the peripheral surface 63 of the toothed sleeve 52 and forms a support for the compression spring 57.

To achieve an effective sealing, the inner diameter of the sealing disc 62 is adapted to match the outer diameter of toothed sleeve 52 with a close tolerance. In contrast, an annular gap 64 is intentionally formed between the outer diameter of the sealing disc 62 and the fitting piece 58 and assures a sealing of the pressure chamber 55 by the sealing disc 62 even in the presence of radial impacts of the driven element 53 and of the toothed sleeve 52 connected thereto.

Figure 5:
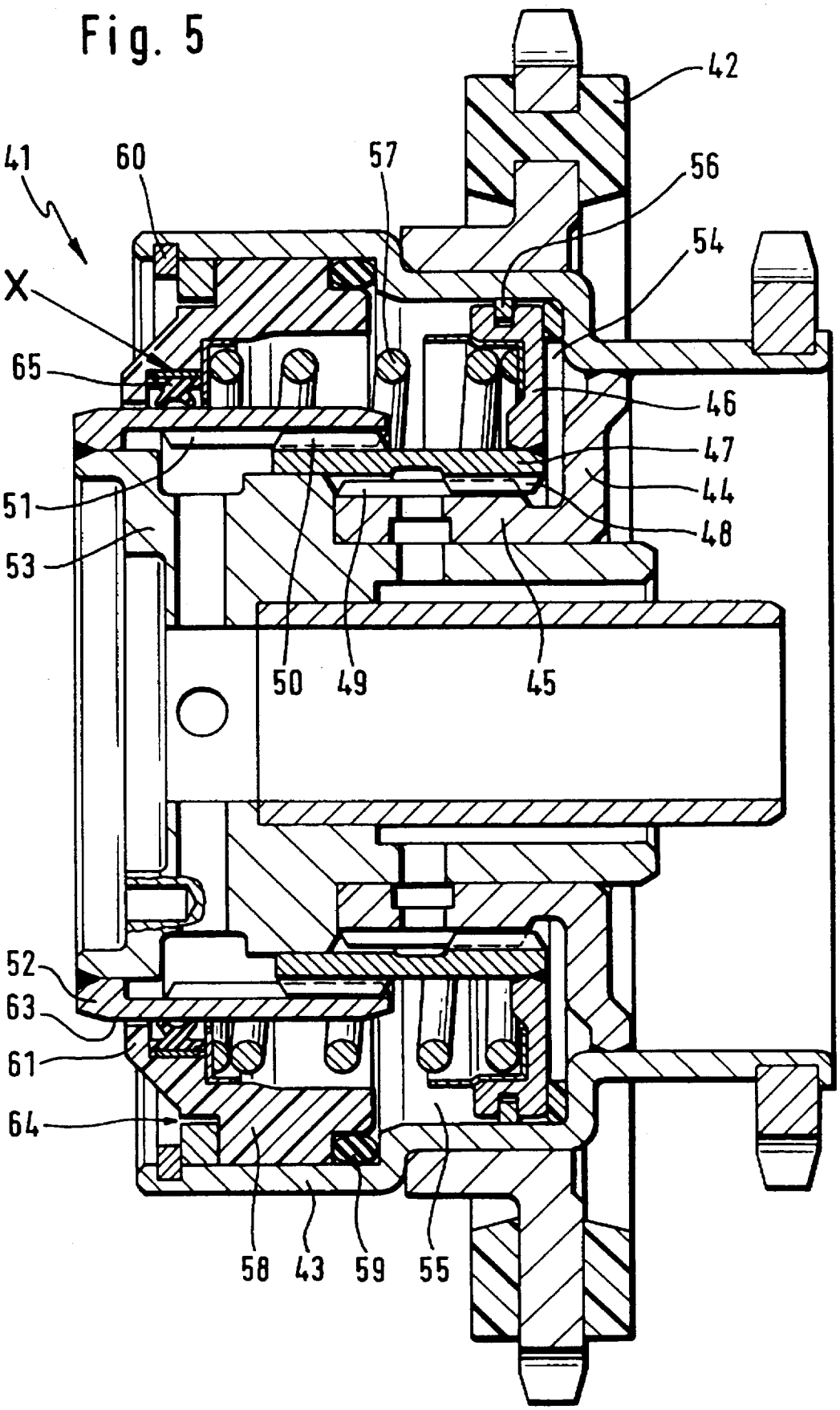
FIG. 5 shows the device of FIG. 4 but with an elastic sealing ring used in place of the sealing disc.

FIG. 5 again shows the device 41 with reference numbers corresponding to FIG. 4. Sealing of the pressure chamber 55 in this case, however, is achieved by a sealing ring 65 which is outwardly surrounded by a sheet metal ring 66 and inserted into the fitting piece 58. The sealing ring 65 comprises two axially spaced sealing lips 67 which, in the installed state, bear with radial pre-tension against the peripheral surface 63 of the toothed sleeve 52.

Figure 6:
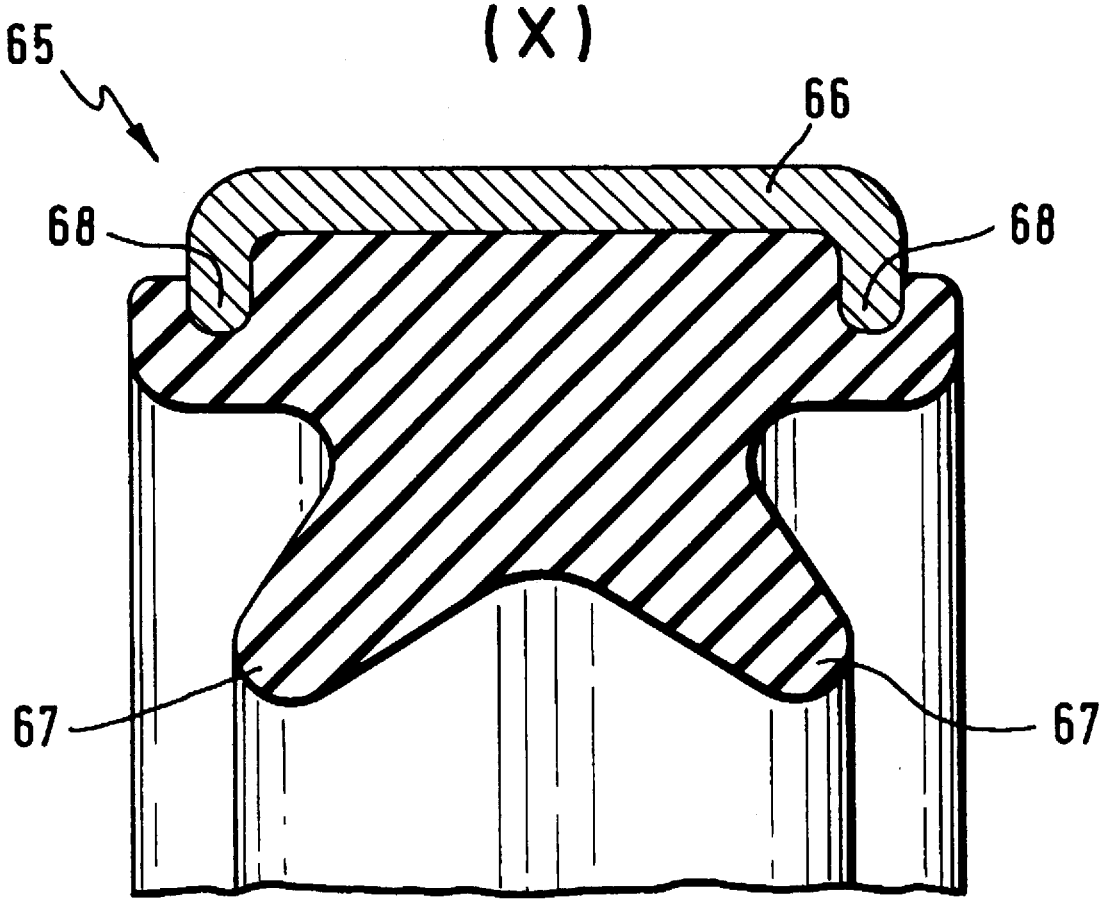
FIG. 6 shows an enlarged view of the sealing ring of FIG. 5.

The enlarged view of the sealing ring 65 in FIG. 6 shows that the sheet metal ring 66 comprises a radially inward oriented flange 68 at each of its ends, and that the flanges 68 are sprayed over with the elastic sealing material of the sealing ring 65.

Various modifications of the sealing device of the invention may be made without departing from the spirit or scope thereof and it is to be understood that the invention is intended to be limited only as defined in the appended claims.

What I claim is:

1. A device for the continuous variation of a relative angular position between a crankshaft and a camshaft arranged in a cylinder head, said device comprising:

A) a drive element (2) driven by the crankshaft through a traction means,

B) a hollow cylindrical sliding sleeve (7) positively locked by a first gearing (8, 9) to the drive element (2) and by a second gearing (10, 11) to the driven element (13), C) a circular ring-shaped double-action hydraulic adjusting piston (6) which is fixed on the sliding sleeve (7) and guided in a housing (3) to axially delimit two pressure chambers (14, 15) which can be connected alternately to a pressure medium supply and a pressure medium discharge, D) a sealing of the pressure chambers (14, 15) from each other by a sealing arrangement on the circular ring-shaped adjusting piston (6) and E) a sealing between the sliding sleeve (7) and a component situated radially inwardly therefrom by a sealing element inserted between end faces (20, 21) of components which are connected directly to the driven element (13) and the drive element (2) respectively, wherein a radially inward sealing of the sliding sleeve (7) is achieved by a sealing disc (17) of continuous configuration comprising an outer peripheral surface (18) which bears sealingly against an inner wall (19) of the sliding sleeve (7), the sealing disc (17) being inserted axially between two components distinct from the sliding sleeve (7).

2. A device of claim 1 wherein the sealing disc (17) has a radial dimension which corresponds both to an end face (20) of a toothed bushing (12) associated directly with the driven element (13) and to an end face (21) of a guide sleeve (22) associated directly with the drive element (2).

3. A device of claim 1 wherein the sealing disc (17) has a higher strength than components supported directly on the sealing disc (17).

4. A device of claim 1 wherein the sealing disc (17) has a maximum wall thickness of 4 mm.

5. A device of claim 1 wherein the sealing disc (17) is made of a material chosen from the group consisting of steels, nonferrous heavy metals and plastics.

6. A device of claim 1 wherein a circumferential bevel (23) is arranged on one end of the sliding sleeve (7) in a transition region to an inner wall (19) thereof.

7. A device for the continuous variation of a relative angular position between a crankshaft and a camshaft arranged in a cylinder head, said device comprising:

A) a drive element (2) driven by the crankshaft through a traction means,

B) a hollow cylindrical sliding sleeve (7) positively locked by a first gearing (8, 9) to the drive element (2) and by a second gearing (10, 11) to the driven element (13), C) a circular ring-shaped double-action hydraulic adjusting piston (6) which is fixed on the sliding sleeve (7) and guided in a housing (3) to axially delimit two pressure chambers (14, 15) which can be connected alternately to a pressure medium supply and a pressure medium discharge, D) a sealing of the pressure chambers (14, 15) from each other by a sealing arrangement on the circular ring-shaped adjusting piston (6) and E) a sealing between the sliding sleeve (7) and a component situated radially inwardly therefrom by a sealing element inserted between end faces (20, 21) of components which are connected directly to the driven element (13) and the drive element (2) respectively, wherein a sealing of the sliding sleeve (7) relative to a component situated radially inwardly therefrom is achieved by a seal (24) of continuous configuration which comprises two axially spaced discs (25, 26) and an elastic intermediate element (27) disposed therebetween, the discs (25, 26) bear sealingly against an inner wall (19) of the sliding sleeve (7), and, in an installed state, the seal (24) is situated axially between two components distinct from the sliding sleeve (7).

8. A device of claim 7 wherein the discs (25, 26) of the seal (24) have a higher strength than components supported directly on the seal (24).

9. A device of claim 7 wherein the intermediate element (27) is undetachably connected to at least one of the discs (25, 26).

10. A device of claim 7 wherein one of the discs (25, 26) is configured as a fitting disc whose inner diameter is made to close tolerances and guided on a peripheral surface of the driven element (13).

11. A device of claim 7 wherein the seal (24) has a radial dimension which corresponds both to an end face (20) of a toothed bushing (12) associated directly with the driven element (13) and to an end face (21) of a guide sleeve (22) associated directly with the drive element (2).

12. A device of claim 7 wherein the seal (24) has a maximum thickness of 4 mm.

13. A device of claim 7 wherein the discs (25, 26) of the seal (24) are made of a material chosen from the group consisting of steels, nonferrous heavy metals and plastics.

14. A device of claim 7 wherein a circumferential bevel (23) is arranged on one end of the sliding sleeve (7) in a transition region to an inner wall (19) thereof.

* * * * *